US010602256B1

(12) United States Patent
Leng et al.

(10) Patent No.: US 10,602,256 B1
(45) Date of Patent: Mar. 24, 2020

(54) EARPHONE AND A METHOD OF OPERATING THE EARPHONE

(71) Applicant: Coros Wearables Inc., Tustin, CA (US)

(72) Inventors: Hu Leng, Shenzhen (CN); Gang Wang, Shenzhen (CN)

( * ) Notice: Subject to any disclaimer, the term of this patent is extended or adjusted under 35 U.S.C. 154(b) by 0 days.

(21) Appl. No.: 16/160,957

(22) Filed: Oct. 15, 2018

(51) Int. Cl.
*H04R 1/10* (2006.01)

(52) U.S. Cl.
CPC ..... *H04R 1/1016* (2013.01); *H04R 1/105* (2013.01); *H04R 1/1041* (2013.01); *H04R 1/1091* (2013.01)

(58) Field of Classification Search
CPC .... H04R 1/1016; H04R 1/1041; H04R 1/105; H04R 1/1091
See application file for complete search history.

(56) References Cited

U.S. PATENT DOCUMENTS

2007/0041595 A1* 2/2007 Carazo ..... H04R 17/00 381/151
2009/0185706 A1* 7/2009 Ito ..... H04R 1/105 381/382
2011/0031059 A1* 2/2011 Parish ..... A61F 11/08 181/129
2015/0096379 A1* 4/2015 Killion ..... A61B 5/123 73/585
2016/0269823 A1* 9/2016 Lee ..... H04R 1/023
2018/0296137 A1* 10/2018 Anderson ..... A61B 5/4836

FOREIGN PATENT DOCUMENTS

CN 201708900 * 1/2011
CN 203086696 * 7/2013

* cited by examiner

*Primary Examiner* — Regina N Holder

(57) ABSTRACT

At least an embodiment discloses an earphone comprising a shell, a signal generator and a first speaker, wherein the signal generator is electrically connected to the first speaker and both the signal generator and the first speaker are within the shell; a first earphone tube including a first end and a second end, wherein the first end of the first earphone tubes is connected to the shell, and the first end of the earphone tube is approximate to the first speaker; and a first earplug connected to the shell via the first earphone tube, wherein a sound generated by the first speaker is transmitted to the first earplug through the first earphone tube.

24 Claims, 10 Drawing Sheets

EARPHONE AND A METHOD OF OPERATING THE EARPHONE

TECHNICAL FIELD

The present application belongs to the technical field of earphones, and more specifically but not exclusively to an air-conduction earphone.

BACKGROUND OF THE INVENTION

An earphone is a converting unit that receives electrical signals from a media player or a receiver and converts them into audible sound waves using speakers that are proximate to the ears. Conventionally, there are only pure sports earphones or traditional in-ear earphones. The conventional earphones cannot be used during certain sports, such as swimming, and are easily damaged. To enhance entertainment during certain sports, it is desirable to design an earphone that is suitable for water and underwater sports, or other environments where the earphones could be exposed to liquids.

BRIEF DESCRIPTION OF THE INVENTION

An embodiment of the present invention aims at providing an earphone that is convenient for use.

According to an embodiment of the invention, an earphone comprises a shell, a signal generator and a first speaker, wherein the signal generator is electrically connected to the first speaker and both the signal generator and the first speaker are within the shell; a first earphone tube including a first end and a second end, wherein the first end of the first earphone tube is connected to the shell, and the first end of the earphone tube is proximate to the first speaker; and a first earplug connected to the shell via the first earphone tube, wherein a sound generated by the first speaker is transmitted to the first earplug through the first earphone tube.

In one embodiment, the shell further comprises a power switch button, a volume up button and a volume down button disposed on an outer upper surface of the shell.

In one embodiment, a first hole is disposed on the shell and proximate to the first speaker, and the first hole is provided with a waterproof and air-permeable membrane.

In one embodiment, the shell further comprises a shell connector protruding from a side of the shell and configured to connect a tube connector disposed on the first end of the earphone tube via a threaded engagement, and the first earphone tube is removably connected to the shell.

In one embodiment, the first end of the earphone tube further comprises a hollow rivet configured to connect to the tube connector.

In one embodiment, the shell connector is hollow.

In one embodiment, the earphone further comprises a waterproof sealing piece disposed between the first earphone tube and the shell connector.

In one embodiment, the waterproof sealing piece comprises a silicone waterproof ring.

In one embodiment, the earphone further comprises a PCB board and a battery, wherein the signal generator is disposed on the PCB board and the PCB board is electrically connected to the battery and disposed in the shell.

In one embodiment, the signal generator includes a sound playback module integrated with the PCB board.

In one embodiment, the signal generator includes a transceiver integrated with the PCB board.

In one embodiment, the signal generator includes a data detector integrated with the PCB board.

In one embodiment, the earphone further comprises a junction disposed between the first earphone tube and the first earplug and configured to be interference fit with the first earplug, and the junction is further configured to be rotatable relative to a longitudinal axis of the first earphone tube so as to convert an alignment of the first earplug relative to a user's ear, wherein the first earplug is removably connected to the first earphone tube.

In one embodiment, the shell further comprises an upper shell and a lower shell configured to engage with each other to form a closed hollow structure.

In one embodiment, the shell further comprises a first speaker chamber configured to form a sealed cavity for the first speaker.

In one embodiment, a snap-fit connector extends from a bottom outer surface of the shell and configured to snapped-fit into a band.

In one embodiment, the earphone further comprises a second speaker, a second earphone tube and a second earplug, wherein the second earphone tube includes a first end and a second end, wherein the first end of the second earphone tubes is removably connected to the shell, and the first end of the second earphone tube is proximate to the second speaker; and the second earplug is removably connected to the shell via the second earphone tube, wherein a sound generated by the signal generator is transmitted to the second earplug through the second earphone tube.

In one embodiment, the shell further comprises a main chamber and a first speaker chamber, wherein the main chamber is configured to hold the signal generator and the first speaker chamber is configured to hold the first speaker, wherein the main chamber is separate from the first speaker chamber, the main chamber is electrically connected to the first speaker chamber through an electric wire, and the first speaker chamber is connected to the first earplug via the first earphone tube.

In one embodiment, a first snap-fit connector extends from a bottom outer surface of the main chamber and configured to be snapped-fit into a band, a second snap-fit connector or a clip extends from a bottom surface of the first speaker chamber and configured to be snapped-fit or clipped to the band.

In one embodiment, the earphone tube is provided with a position adjustable tube clip configured to clamp the earphone tube to a band.

In one embodiment, the tube clip is a U-shaped clip, and clamping portions of the tube clip is made of elastic material.

Compared with the conventional earphone, earphones according to embodiments use an earphone tube to transmit sound, which is convenient to use, and allows users to listen to music during exercise, such as swimming or jogging. For example, the earphones according to embodiment of the invention can be used in combination with other swimming tools, in particular swimming goggles, with a shell of the earphone fastened to the swimming goggle headband or belt. Alternatively, a clip may be added on the earphone tubes on both sides and configured to clip the earphone tube onto the swimming goggle headband or belt to prevent the earphone tube from being washed away by water during swimming. In one embodiment, the earphone can further comprises a junction that can rotate an earplug connected thereto so as to adjust an alignment of the earplug relative to a user's ear, therefore maximizing the user's comfort.

BRIEF DESCRIPTION OF THE DRAWINGS

In the accompanying drawings, like reference numerals refer to like elements throughout drawings.

Figure 1:
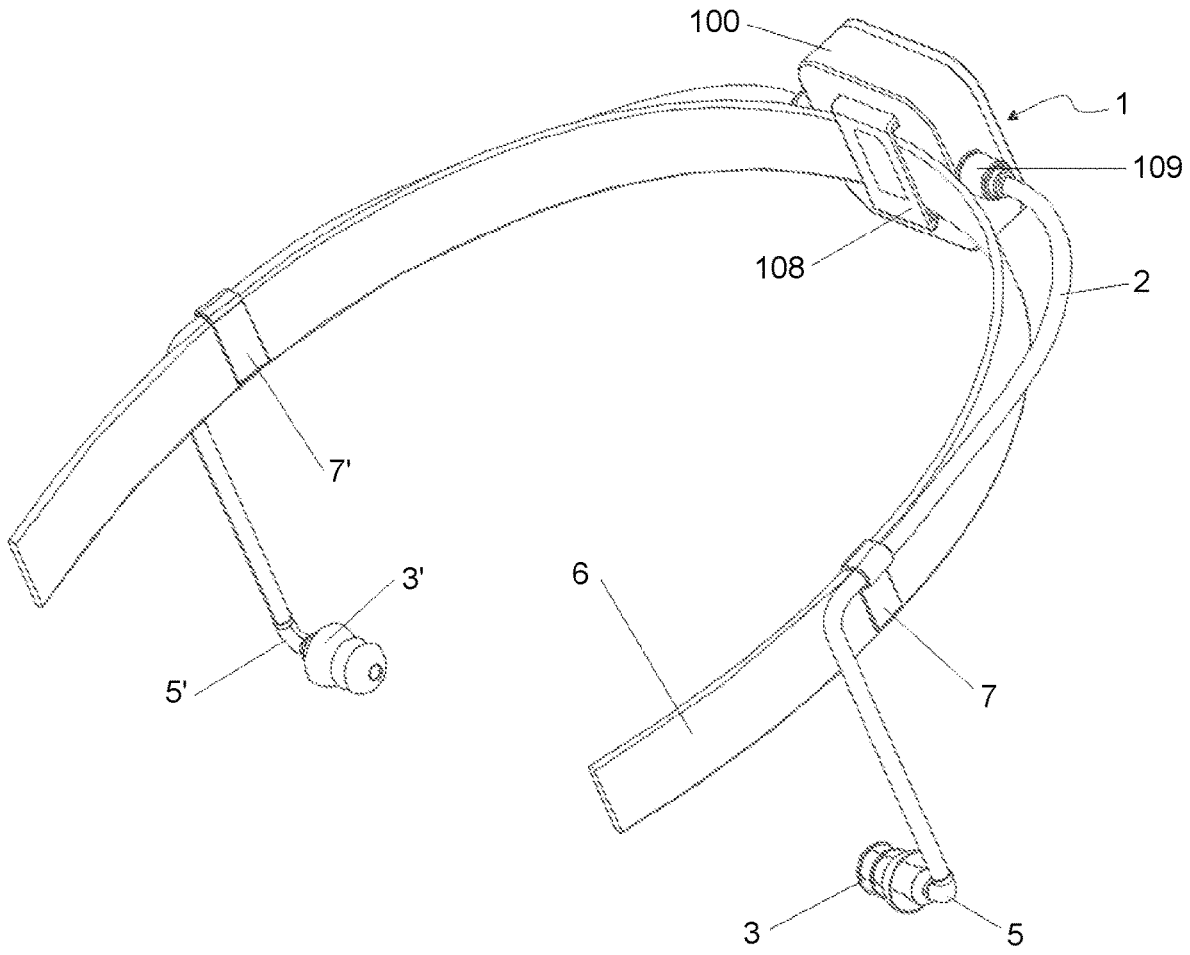
FIG. 1 is a schematic diagram of an earphone according to an embodiment of the invention.

Throughout the drawings, the earphone is represented as 1, the shell is represented as 100, the main chamber is represented as 1001, a first speaker chamber is represented as 1002, a first speaker is represented as 101, a first hole is represented as 102, a first speaker support is represented as 103, a waterproof and air-permeable membrane is represented as 104, a shell connector is represented as 105, a PCB board is represented as 106, a battery is represented as 107, a snap-fit connector is represented as 108, a tube connector is represented 109, a first earphone tube is represented as 2, a hollow rivet is represented as 201, a first earplug is represented as 3, a waterproof sealing piece is represented as 4, a junction is represented as 5, a headband or belt is represented as 6, a tube clip is represented as 7, an electric wire is represented as 8, a power switch button is represented as 112, a volume up button is represented as 113, and a volume down button is represented as 114.

DETAILED DESCRIPTION OF EMBODIMENTS

Although the present invention will be described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense.

Throughout the specification, it will be understood that when a unit is referred to as being "connected" to another element, it may be "directly connected" to the other element or "electrically connected" to the other element in a state in which intervening elements are present.

The term "coupled to" refers to elements being connected or united by fastening, adhering, bonding, etc. by any method suitable for the elements being fastened, secured, or joined, together and their constituent materials. Many suitable methods for coupling elements together are well-known, including adhesive bonding, pressure bonding, thermal bonding, mechanical fastening, etc. Such coupling methods may be used to attach elements together over a particular area either continuously or intermittently. The term "coupled to" includes elements which are integrally formed from another element.

In the following description, some orientation terms, such as "left," "right," "top," "bottom," "front," "back," "guide," "forwards," and "backwards," are used with reference to the directions shown in the drawings, and the orientation terms are used as example rather than limitation. However, it should be appreciated that the described embodiments are only used to illustrate the special form for implementing and applying the present invention in an exemplary manner, rather than limit the scope of the present invention.

The term "longitudinal" is used herein to refer to a direction which is generally parallel to the longest edge of an element except where otherwise noted. Directions within ±45 degrees of the longitudinal direction are considered to be "longitudinal".

The term "lateral" refers to a direction running generally perpendicular to and in the same plane as the "longitudinal" direction. Directions within ±45 degrees of the lateral direction are considered to be "lateral."

In the description of the present disclosure, certain detailed explanations of the related art are omitted when it is deemed that they may unnecessarily obscure the essence of the inventive concept. While the terms including an ordinal number, such as "first," "second," etc., may be used to describe various components, such components are not be limited by these terms. The terms first and second should not be used to attach any order of importance but are used to distinguish one element from another element.

Furthermore, components of the specification are divided in accordance with a main function of each component. For example, combining two or more elements are in a single component, as needed, or may be one component configuration is subdivided into two or more components. Each of the components may further perform some or all of the functions of other components as well as its main functions, and some of the main functions may also be performed by other components.

Hereinafter, embodiments of the present invention will be described in detail with reference to the accompanying drawings.

Reference will now be made in detail to embodiments, examples of which are illustrated in the accompanying drawings. In this regard, the present embodiments may have different forms and should not be construed as being limited to the descriptions set forth herein. Accordingly, the embodiments are merely described below, by referring to the figures, to explain aspects of the present description. Expressions such as "at least one of", when preceding a list of elements, modify the entire list of elements and do not modify the individual elements of the list.

Figure 2:
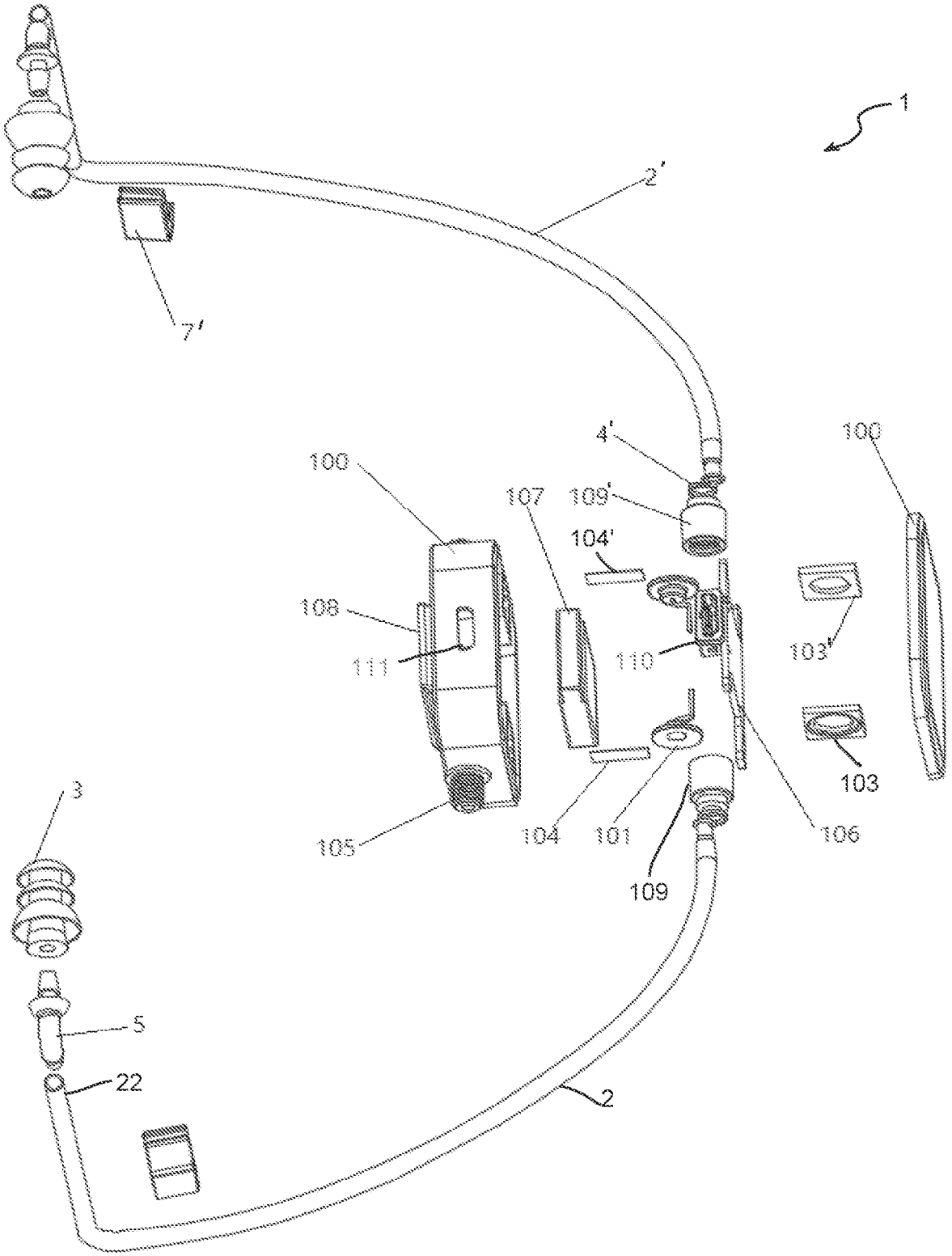
FIG. 2 is an exploded view of the structure of the earphone shown in FIG. 1.
Figure 3:
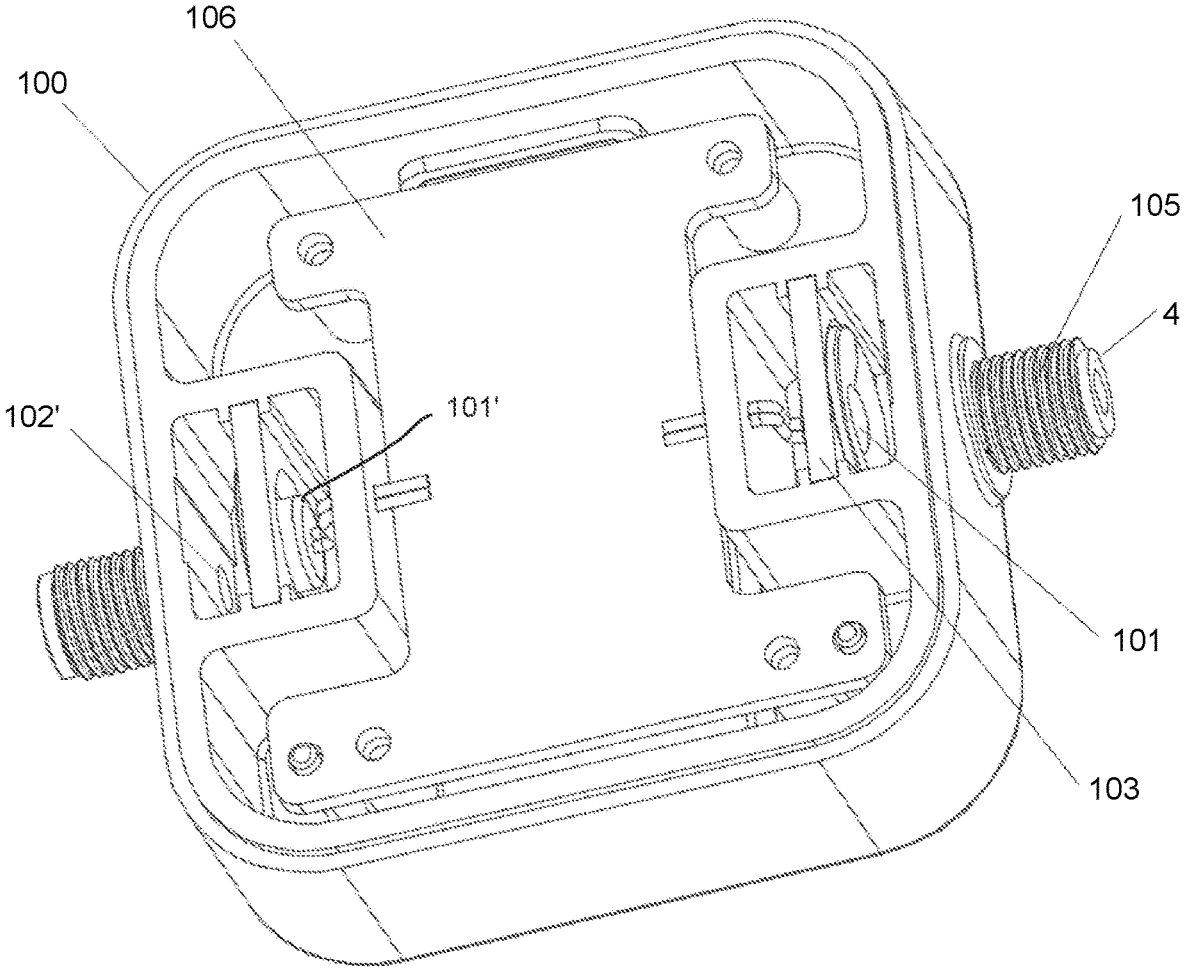
FIG. 3 is a schematic diagram of an internal structure within a shell of the earphone shown in FIG. 1.

FIGS. 1-3 shows an earphone according to an embodiment of the invention. FIG. 1 is a schematic diagram of an earphone 1 according to an embodiment of the invention. FIG. 2 is an exploded view of the structure of the earphone 1 shown in FIG. 1. FIG. 3 is a schematic diagram of an internal structure within a shell 100 of the earphone shown in FIG. 1. Referring to FIGS. 1-3, the earphone 1 comprises at least a shell 100, a signal generator (the signal generator is not shown in the drawings because a PCB board 106 includes the signal generator) and a first speaker 101. The signal generator is electrically connected to the first speaker 101 and both the signal generator and the first speaker 101 are within the shell 100. A first earphone tube 2 includes a first end 20 and a second end 22, wherein the first end 20 of the first earphone tube 2 is connected to the shell 100, and the first end 20 of the first earphone tube 2 is proximate to the first speaker 101. A first earplug 3 is connected to the shell 100 via the first earphone tube 2, wherein a sound generated by the first speaker 101 is transmitted to the first earplug 3 through the first earphone tube 2.

The signal generator comprises a module or an electronic component for implementing the function of a player. For example, the signal generator comprises a sound playback module integrated with a PCB board 106. Alternatively, the signal generator may include any one or more of heart beat detector, pulse detector, breath detector, speed sensor, gyroscope, magnetometer or accelerometer for detecting sports distance or position, or state of the user. For example, the signal generator includes a data detector, or a transceiver integrated with the PCB board 106.

The shell 100 and the earplug 3 are connected through the earphone tube 2, and the connectors, such as shell connector 105 and tube connector 109 between the shell 100 and the first earphone tube 2, and the junction 5 between the first earphone tube 2 and first earplug 3 are provided with sealing pieces for sealing and waterproof. The first speaker 101 in the shell 100 transmits sound to the first earplug 3 through the first earphone tube 2. Alternatively, the shell 100 and the first earphone tube 2 are clamped by a snap-fit connector 108 or a clip to a headwear, such as a belt, a headband or swimming goggles.

Embodiment 1

As shown in FIGS. 1-3, the earphone 1 includes a shell 100 and a first earphone tube 2. The earphone tube 2 can be made of a plastic tube, such as a soft and flexible plastic tube. The second end 20 of the first earphone tube 2 is connected with the first earplug 3 which in turn can be inserted into the ear of a user, and the first end 22 of the first earphone tube 2 is connected to the shell 100. Note although FIGS. 1-3 show a pair of earphone tubes including a first earphone tube 2 and a second earphone tube 2' and a pair of earplugs including a first earplug 3 and a second earplug 3', embodiments of the invention can also apply to a monophonic scenario. That is, the earphone 1 includes only a first speaker 101, the first earphone tube 2 and the first earplug 3. Alternatively, the earphone includes only the second speaker 101', a second earphone tube 2' and the second earplug 3'. Further, although some embodiments may be discussed in a monophonic scenario, it is also appreciated that embodiments can also be applied to dual track or stereo scenario by including both speakers 101 and 101', both earphone tubes 2 and 2' and both earplugs 3 and 3' and other accompanying elements.

As shown in FIGS. 1-3, the pair of earphone tubes 2 and 2' are symmetrically provided on both sides of the earphone 1. The earphone 1 includes a shell 100, a signal generator, and a first speaker 101 and a second speaker 101', with a pair of supports 103 and 103' for holding the first and second speakers 101 and 101' within the shell 100. The shell 100 includes upper and lower shells to form a closed and sealed hollow structure. The first speaker 101 and the second speaker 101' are sealed in separate cavities, as they correspond to a left sound channel and a right sound channel respectively and both need a separate sealed cavity. The signal generator is connected to the first speaker 101. Both the signal generator and the first speaker 101 are sealed in the shell 100. The first speaker 101 is proximate to the first earphone tube 2. As both the signal generator and the first speaker 101 are sealed in the shell 100, electronic components in the shell 100 are less susceptible to damage by liquids, such as water during swimming. The sound generated by the first speaker 101 is transmitted to the first earplugs 3 through the first earphone tube 2.

As shown in FIG. 3, a second hole 102' is disposed on the shell 100 and proximate to the second speaker 101', and the second hole 102' is provided with a waterproof and air-permeable membrane 104' shown in FIG. 2. For example, a pair of speakers 101 and 101' are respectively fixed within the two cavities on both sides of the shell 100 through the speaker supports 103 and 103'. The first hole 102 is disposed on the shell 100, and the first hole 102 is located at a side of the shell 100 that is proximate to the first earphone tube 2. The first hole 102 is provided with a waterproof air-permeable membrane 104. When the first earphone tube 2 is filled with water, the waterproof air-permeable membrane 104 can prevent water from entering the shell 100 and therefore affecting the first speaker 101 to generate sound.

Alternatively, the first earphone tube 2 is removably connected to the shell 100 of the earphone 1. The shell 100 further comprises a shell connector 105 protruding from a side of the shell 100 and configured to connect a tube connector 109 disposed on the first end 20 of the first earphone tube 2 via a threaded engagement. The shell connector 105 is hollow. An advantage of threaded engagement is the ease of disassembling the first earphone tube 2 from the shell 100, for example, to discharge water.

As shown in FIG. 2, the shell connector 105 connecting to the first earphone tube 2 is disposed on the shell 100 of the earphone 1. The shell connector 105 and the shell 100 may be integrally formed. A waterproof sealing piece 4 is disposed between the first earphone tube 2 and the shell connector 105. For example, the waterproof sealing piece 4 may be pressed on the shell connector 105 as shown in FIG. 3. The waterproof sealing piece 4 may be a silicone waterproof ring. The first earphone tube 2 is connected to the shell connector 105 and sealed by the waterproof sealing piece 4, and the shell connector 105 and the earphone tube 2 are removably connected by a screw thread fit. For example, the shell connector 105 includes an external thread, and the tube connector 109 of the first earphone tube 2 includes an internal thread to mate with the external thread of the shell connector 105.

Figure 10:
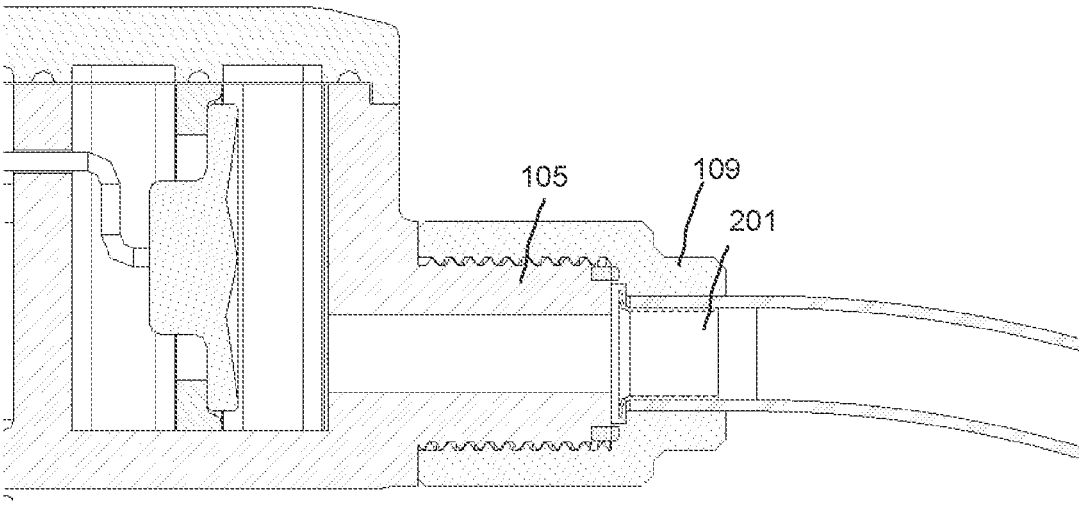
FIG. 10 is a partial view of a threaded connection between a tube connector and a shell connector.

FIG. 10 is a partial view of a threaded connection between the tube connector 109 and a shell connector 105. When the tube connector 109 of the first earphone tube 2 is fastened to the shell connector 105, the waterproof sealing ring 4 is pressed between the shell connector 105 and the tube connector 109 of the first earphone tube 2 to be waterproof. When there is water in the first earplug 3, the waterproof sealing ring 4 provides waterproof protection, and the waterproof air-permeable membrane 104 at the first hole 102 provides additional waterproof protection to protect the internal components of the first speaker 101 and the shell 100 from water. The first earphone tube 2 and the shell 100 can be detached, for example to facilitate the removal of any incoming water.

Further, the earphone 1 includes a PCB board 106 and a battery 107. The signal generator (not shown in the drawings) is disposed on the PCB board 106, and the PCB board 106 is electrically connected to the battery 107. Both the PCB board 106 and the battery 107 are located within the shell 100. The battery 107 supplies power to the earphone 1.

In one embodiment, the signal generator may comprise an audio player, for example, an MP3 player, a radio or a module for playing music from an online source. In this embodiment, an MP3 player is used, and the MP3 player may be integrated in the PCB board 106. An example of an MP3 player is an Microchip Technology, Inc. AT83SND2CMP3. The signal generator creates audio signals to drive signals 101 and 101', from a stored data file, received radio data signal, data content received from a network connection, or data content received via USB interface. Additional or alternative function module can also be built into the PCB board 106 as needed. Such function module, for example, may control hardware settings and related control module settings for the data collected in the swimming state. Alternatively, the PCB board 106 is connected to a USB interface 110. The USB interface 110 is placed in a USB opening 111 disposed on the shell 100. The USB interface 110 is a waterproof USB, and the PCB board 106 and the battery 107 are placed in a cavity within the shell. The USB interface is located on the shell of the cavity. The cavity is waterproof and sealed.

Figure 9:
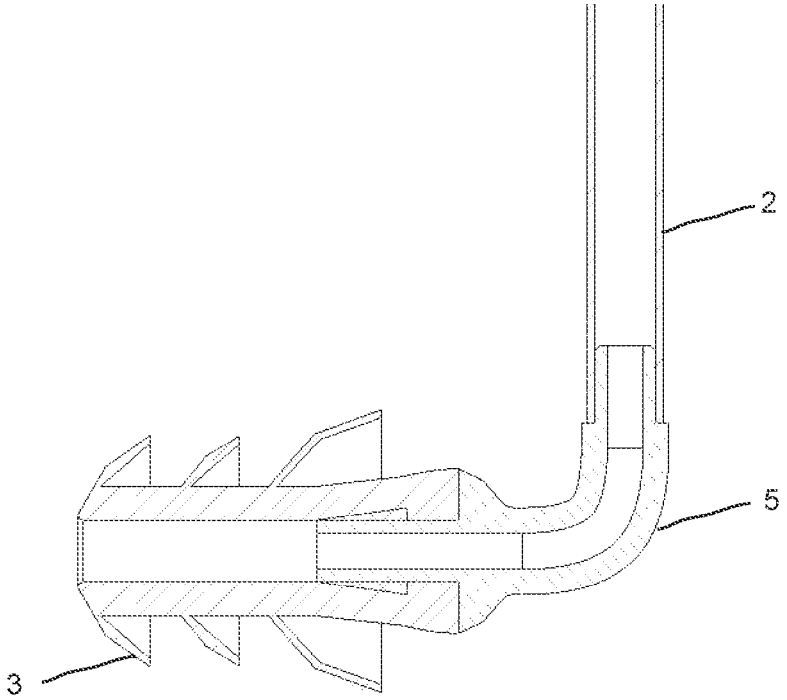
FIG. 9 is a partial view showing an interference fit between a first earplug and a junction.

FIG. 9 is a partial view showing an interference fit between the first earplug 3 and a junction 5. As shown in FIG. 9, the earphone 1 further comprises the junction 5 disposed between the first earphone tube 2 and the first earplug 3 and configured to be interference fit with the first earplug 3. The junction 5 is further configured to be rotatable relative to a longitudinal axis of the first earphone tube 2 so as to change an alignment of the first earplug 3 relative to a user's ear. The first earplug 3 is removably connected to the first earphone tube 2. With the junction 5, the user can adjust the alignment of the earplug with respect to the ear as needed, so as to provide a more comfortable experience to the user. The junction 5 can be made of plastic, such as soft plastic, for example, thermoplastic polyurethanes (TPU) or thermoplastic elastomer (TPE) or hard plastic, such as Polycarbonate (PC), Acrylonitrile Butadiene Styrene (ABS), or polyamide (PA), and is flexible. As shown in FIG. 9, the junction 5 includes a protruding (male) part to fit into a concave (male) structure of the first earplug 3.

Figure 4:
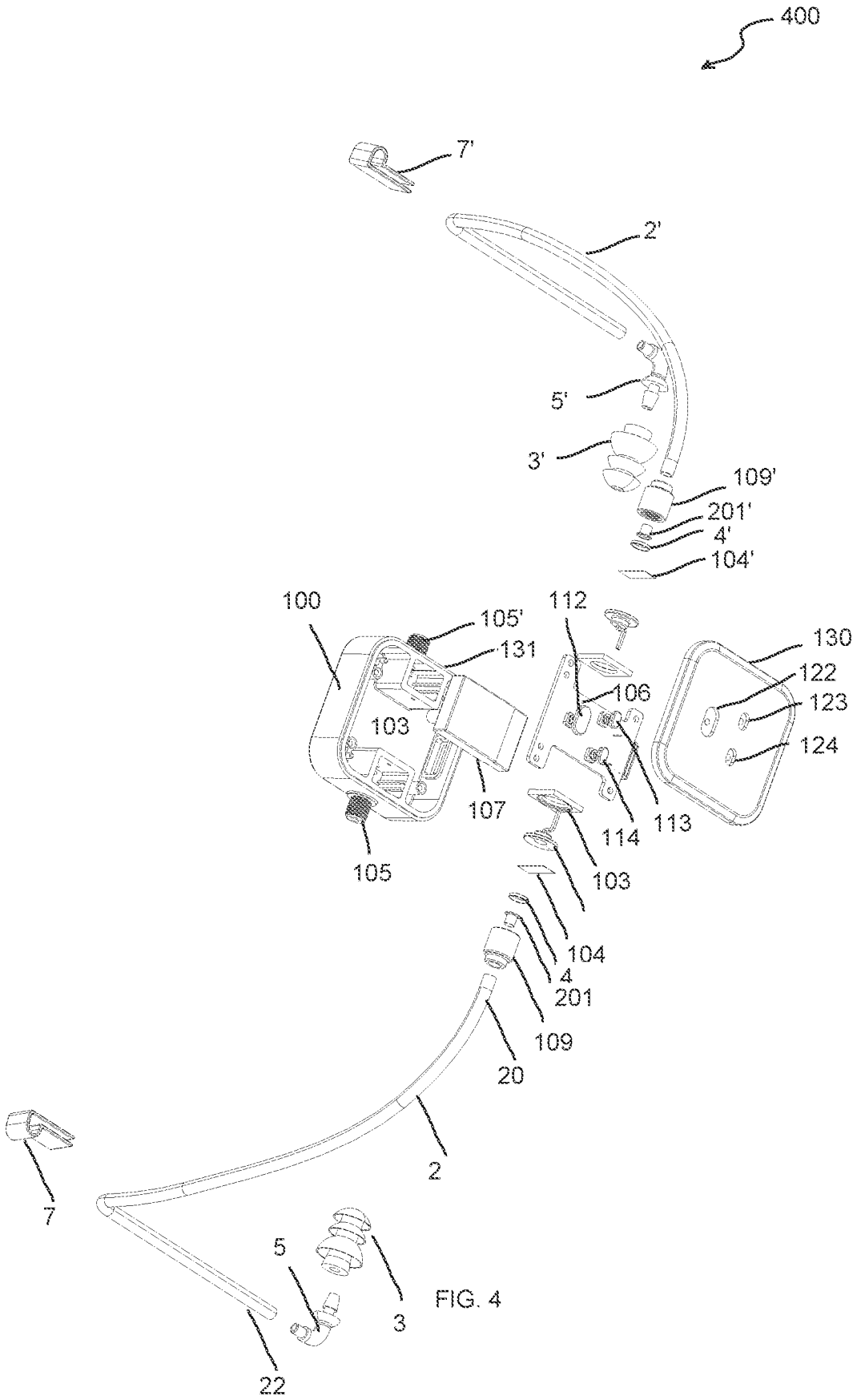
FIG. 4 a schematic diagram of a structure of an earphone according to a further embodiment of the invention.

Referring to FIG. 4, FIG. 4 is a schematic diagram of a structure of an earphone 400 according to a further embodiment of the invention. The first end 20 of the first earphone tube 2 further comprises a hollow rivet 201 configured to connect to the tube connector 109. The hollow rivet 201 can be inserted into the first end 20 of the first earphone tube 2 and fastened by glue, and then the tube connector 109 is sleeved on the first end 20 of the earphone tube 2 and fastened by glue. The tube connector 109 is provide with an internal thread and the tube connector 109 is connected to the shell connector 105 by a threaded fit. The second end 22 of the first earphone tube 2 can be connected to the junction 5 as discussed above in order to connect to the first earplug 3. The first earplug 3 can be made of soft plastic, such as thermoplastic polyurethanes (TPU), thermoplastic elastomer (TPE), polyethylene (PE) or silicone, and be connected to the junction 5 by interference fit, so that the earplug 3 is replaceable.

Referring back to FIG. 1, alternatively, the shell 100 is provided with a snap-fit connector 108, and the snap-fit connector 108 is fastened to a band, such as a band-shaped headwear (for example, a swimming goggles headband or belt 6). Alternatively, the headwear may have other shapes and thickness such as a swimming cap, a head band that partially or fully goes around the user's head etc., and can use other coupling apparatuses or methods to couple the shell 100. The direction of the opening of the snap-fit connector 108 can be adjusted. For example, when a swimming goggle belt is used, the shell is hung on the swimming goggles with the opening of the snap-fit connector 108 facing downwards. If a swimming cap is used, the opening of the snap-fit connector 108 can be directed to face upwards to be fastened on the swimming cap.

Alternatively, the first earphone tube 2 is provided with a tube clip 7 with its position adjustable. The tube clip 7 can be located above the ear, and the position of the tube clip 7 can be adjusted according to the user's personal preference. The tube clip 7 clamps the first earphone tube 2 to the band-shaped headwear (for example, the swimming goggles belt 6) to prevent the first earphone tube 2 from being washed away by water during swimming. The tube clip 7 can be a U-shaped clip, and the clamping portion of the tube clip 7 comprises two pieces of elastic material. The two pieces contact each other in a natural state, and the two pieces hold the swimming goggles belt 6 between the two clamping portions when use. The U-shaped bottom of the tube clip 7 is provide with an arc portion for the first earphone tube 2 to pass through and fasten the earphone tube 2.

Figure 5:
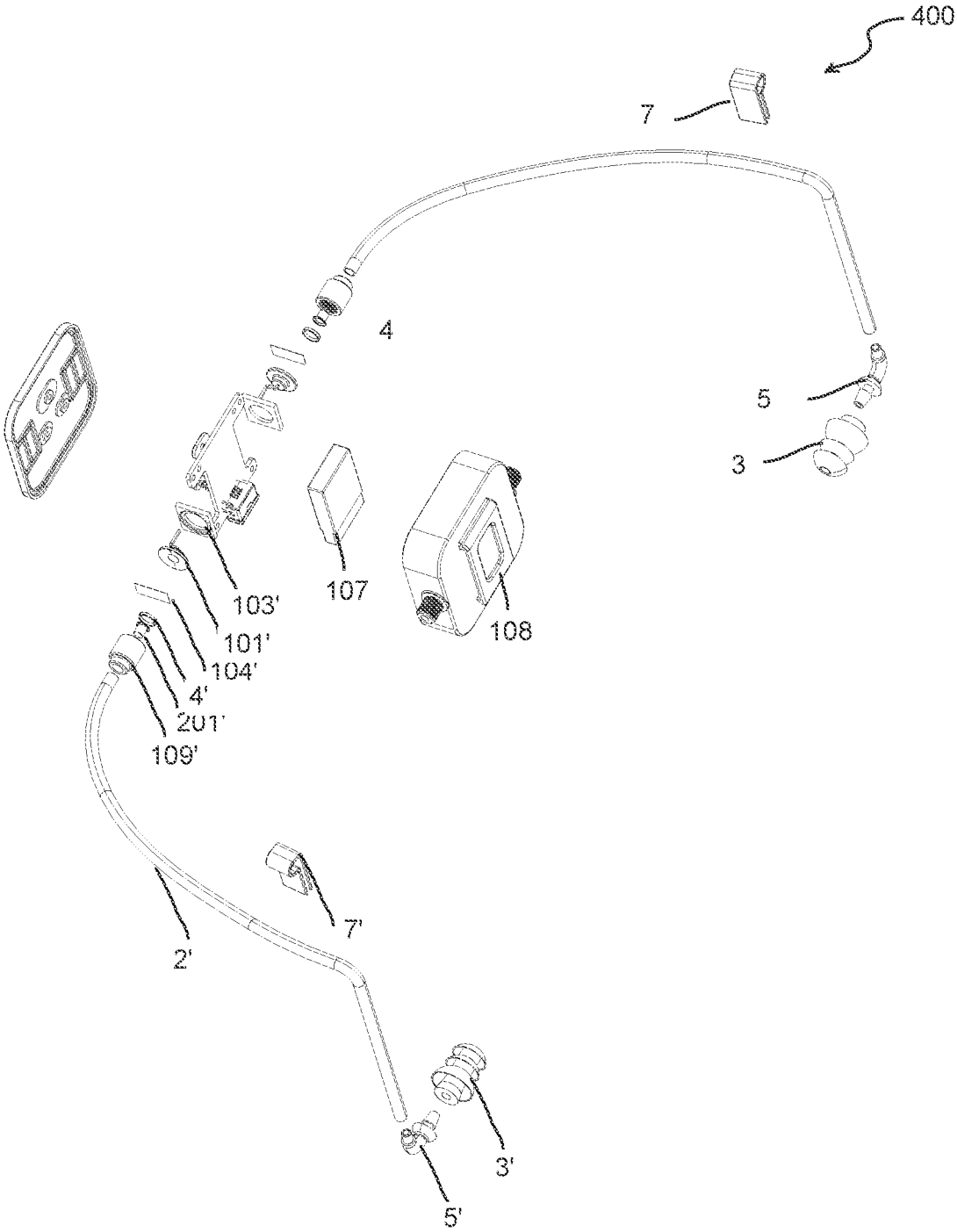
FIG. 5 a schematic diagram of a rear view of the structure of the earphone shown in FIG. 4.
Figure 6:
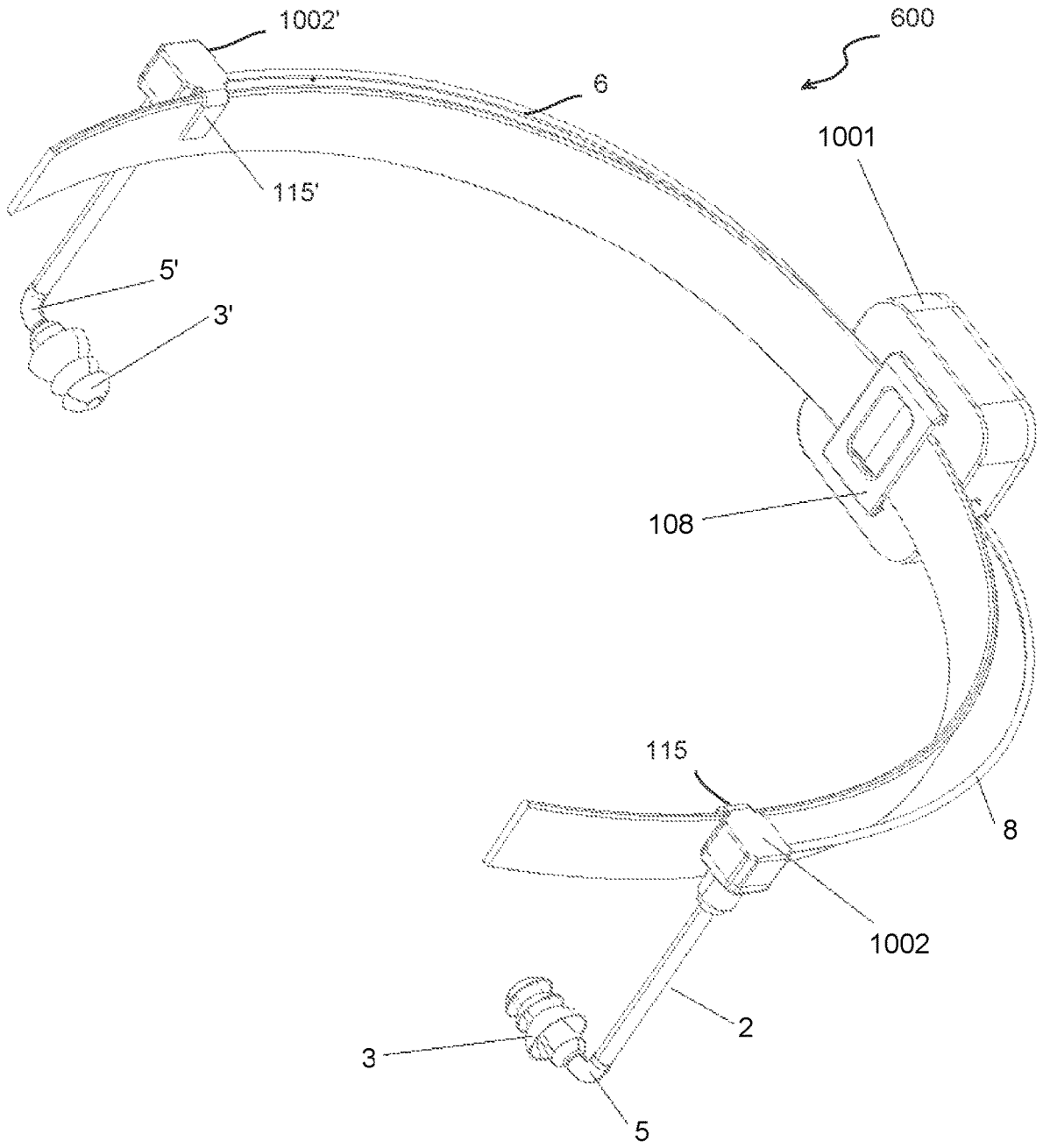
FIG. 6 is a schematic diagram of a structure of an earphone according to another embodiment of the invention.

Now referring to FIGS. 4 and 5, FIG. 5 is a schematic diagram of a rear view of the structure of the earphone 400 shown in FIG. 4. The shell 100 further comprises an upper shell 130 and a lower shell 131 configured to engage with each other to form a closed hollow structure. Further, the earphone 400 includes, in addition to the shell 100, the first and second speakers 101 and 101', the first and second speaker supports 103 and 103', the waterproof and air-permeable membranes 104 and 104', the shell connectors 105 and 105', the PCB board 106, the battery 107, the snap-fit connector 108, the tube connectors 109 and 109', the first and second earphone tubes 2 and 2', hollow rivets 201 and 201', the first and second earplugs 3 and 3', the waterproof sealing pieces 4 and 4', the junctions 5 and 5', the tube clips 7 and 7' as discussed with respect to FIGS. 1-3, a power switch 112, a volume up button 113, and a volume down button 114 disposed on the PCB board 106, and corresponding power switch 122, volume up bottom 123 and volume down button 114 disposed on the upper shell 130 of the shell 100. Note the upper shell 130 is water proof to prevent water from flowing inside the shell 100. Note although the power switch 112, the volume up button 113, and the volume down button 114 are shown in FIGS. 5 and 6, alternative or additional buttons may be added, or these buttons may be removed. For example, the earphones 1 do not include any control buttons and are controlled remotely.

Embodiment 2

Figure 7:
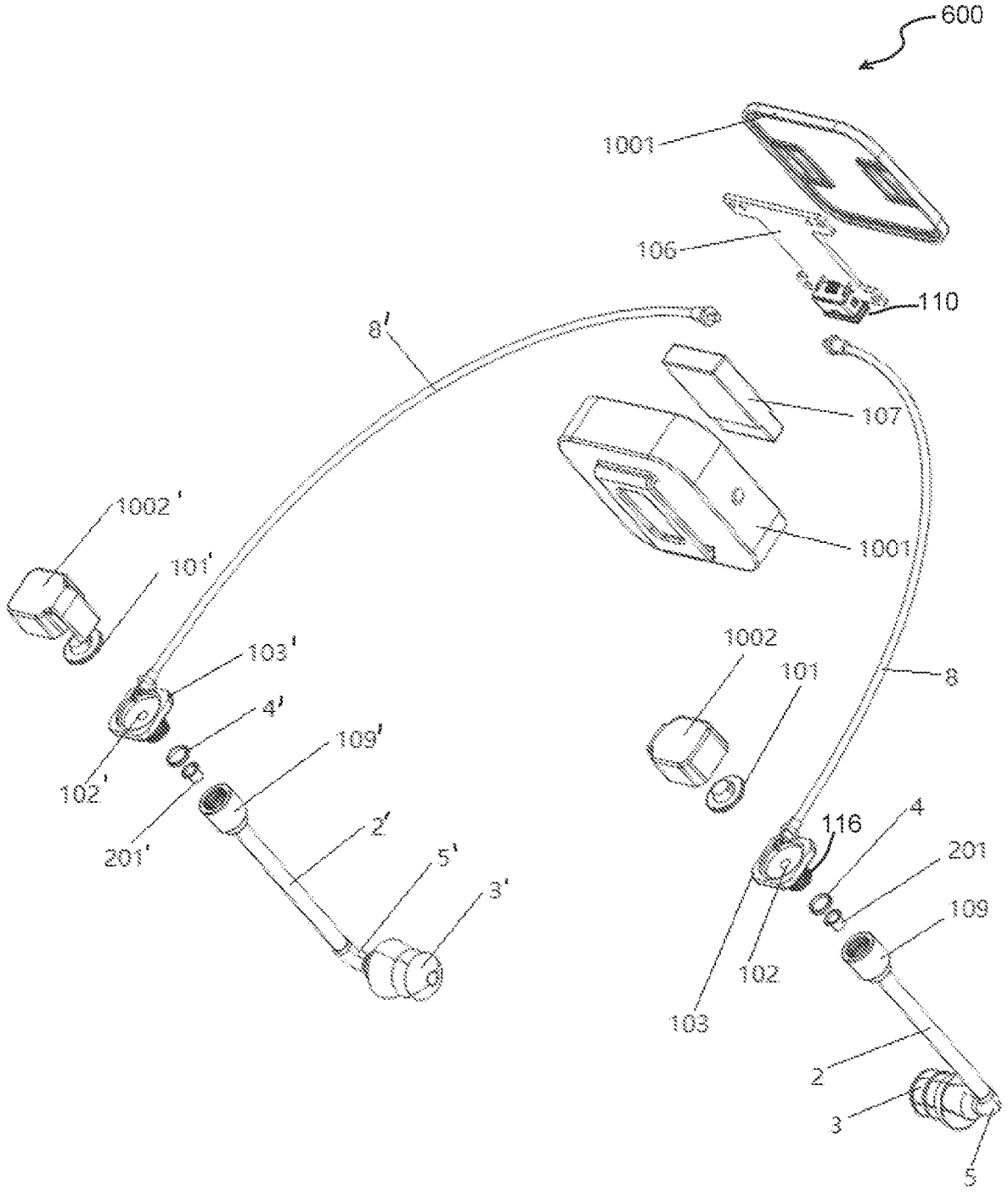
FIG. 7 is an exploded view of the earphone shown in FIG. 6.

FIG. 6 is a schematic diagram of a structure of an earphone 600 according to another embodiment of the invention. FIG. 7 is an exploded view of the earphone 600 shown in FIG. 6.

As shown in FIGS. 6-7, the differences between embodiment 2 and embodiment 1 at least comprise: the shell 100 of the earphone 1 includes a main chamber 1001 and a first speaker chamber 1002 and second speaker chamber 1002', wherein the main chamber 1001 is configured to hold the signal generator, the first speaker chamber 1002 is configured to hold the first speaker 101, and the second speaker chamber 1002' is configured to hold the second speaker 101'. The main chamber 1001 is separate from the first speaker chamber 1002 and the second speaker chamber 1002'. The main chamber 1001 is electrically connected to the first speaker chamber 1002 through an electric wire 8, and the first speaker chamber 1002 is connected to the first earplug 3 via the first earphone tube 2. The main chamber 1001 is electrically connected to the second speaker chamber 1002' through an electric wire 8', and the second speaker chamber 1002' is connected to the second earplug 3' via the second earphone tube 2'. Note the electric wire 8, 8' may be sealed within the earphone tube 2, 2', although earphone tube 2, 2' is not shown in FIG. 6 or 7.

The first and second speaker chambers 1002 and 1002' are provided to be proximate to the user's ear. The main chamber 1001 and two speaker chambers 1002 and 1002' are respectively sealed. The outer wall of the main chamber 1001 is provided with a snap-fit connector 108, and the snap-fit connector 108 can be fastened relative to the outer wall of the main chamber 1001 to fasten the main chamber 1001 to a headwear. At least the signal generator, the battery 107 and the PCB board 106 are electrically connected to each other and are disposed within the main chamber 1001. A second snap-fit connector 115' is disposed on the external wall of the second speaker chamber 1002', to fasten the second speaker chamber 1002' on the headwear and is adjustable in position relative to the headwear.

As shown in FIG. 7, the first speaker support 103 and the first speaker 101 are disposed inside the first speaker chamber 1002, and the second speaker support 103' and the second speaker 101' are disposed inside the second speaker chamber 1002'. The first speaker 101 is fixed within the first speaker chamber 1002 through the first speaker support 103. A first hole 102 is disposed at a position corresponding to the first speaker 101 on the wall of the first speaker chamber 1002, and a waterproof air-permeable membrane 104 is disposed on the first hole 102 within an internal surface of the first speaker chamber 1002. The first speaker chamber 1002 and the first earplug 3 are connected through the first earphone tube 2 and the junction 5. The signal generator within the main chamber 1001 is electrically connected to the first speaker 101 in the first speaker chamber 1002 through the electric wire 8. The electric wire 8 may be placed inside the first earphone tube 2 (not shown) to provide protection from the environment. The main chamber 1001 and the first speaker chamber 1002 may be removably connected via the electric wire 8. The first speaker chamber 1002 and the first earphone tube 2 are connected via a first speaker connector 116 and the tube connector 109. A first hollow rivet 201 can be inserted into the earphone tube 2 and fastened by glue, and then the tube connector 109 is sleeved on the earphone tube 2 and fastened by glue. A waterproof sealing piece 4 is placed on the first speaker connector 116 to seal the first speaker chamber 1002. The first earphone tube 2 may be removably connected to the first earplug 3 via the junction 5.

For example, a tube connector 109 is provided on the first earphone tube 2 to provide a detachable connection between the first earphone tube 2 and the first speaker chamber 1002. The first speaker chamber 1002 is provided with the first speaker connector 116 protruding from an external surface of the first speaker chamber 1002 to connect to the first earphone tube 2. The first speaker connector 116 may be integrally formed on the first speaker chamber 1002. The first speaker connector 116 and the tube connector 109 are detachably connected by a screwing engagement. A water proof sealing piece 4 has a diameter smaller than the diameter of the first speaker connector 116, and the water proof sealing piece 4 is placed on the outer surface of the first speaker connector 116, similar to the arrangement of the water proof sealing piece 4 shown in FIG. 4. Therefore, when the earphone tube 2 and the first speaker connector 116 are tightened, the waterproof sealing piece 4 is pressed. The first speaker 101 is fixed in the first speaker chamber 1002 through the first speaker support 103. The first hole 102 is disposed on the first speaker chamber 1002 facing the first speaker 101. The first hole 102 is located within the first speaker chamber 1002. The first hole 102 is coupled to the first earphone tube 2. The first hole 102 is provided with a waterproof air permeable membrane (not shown). When there is water in the first earplug 3, the waterproof sealing ring 4 serves as a first waterproof protection, and the waterproof air permeable membrane at the first hole 102 serves as a second waterproof protection to protect the internal components of the first speaker 101 and the first speaker chamber 1002 from water. Further, the electric wire 8 and the main chamber 1001 can be disassembled to discharge the incoming water.

The first snap-fit connector 108 extends from a bottom outer surface of the main chamber 1001 and configured to be snapped-fit into a band, and a second snap-fit connector or a clip 115 extends from a bottom surface of the first speaker chamber 1002 and configured to be snapped-fit or clipped to the band. As the first snap-fit connector 108 has been discussed with respect to FIGS. 1-6, their descriptions are omitted for simplicity, and the prior descriptions of the snap-fit connector 108 apply to these embodiments as well. The second snap-fit connector 115 is provided on the outer wall of the first speaker chamber 1002. The second snap-fit connector 115 may be made of elastic material. One end of the second snap-fit connector 115 can be integrally formed on the outer wall of the first speaker chamber 1001. The other end of the second snap-fit connector 115 is a free end. Under elasticity and in a natural state, the free end of the second snap-fit connector 115 contacts the external wall of the first speaker chamber 1002, and a band 6 can be clamped by the second snap-fit connector 115. When it is necessary to remove the band 6 from the earplug 1, the free end of the second snap-fit connector 115 can be pulled outward to release the belt 6.

Figure 8:
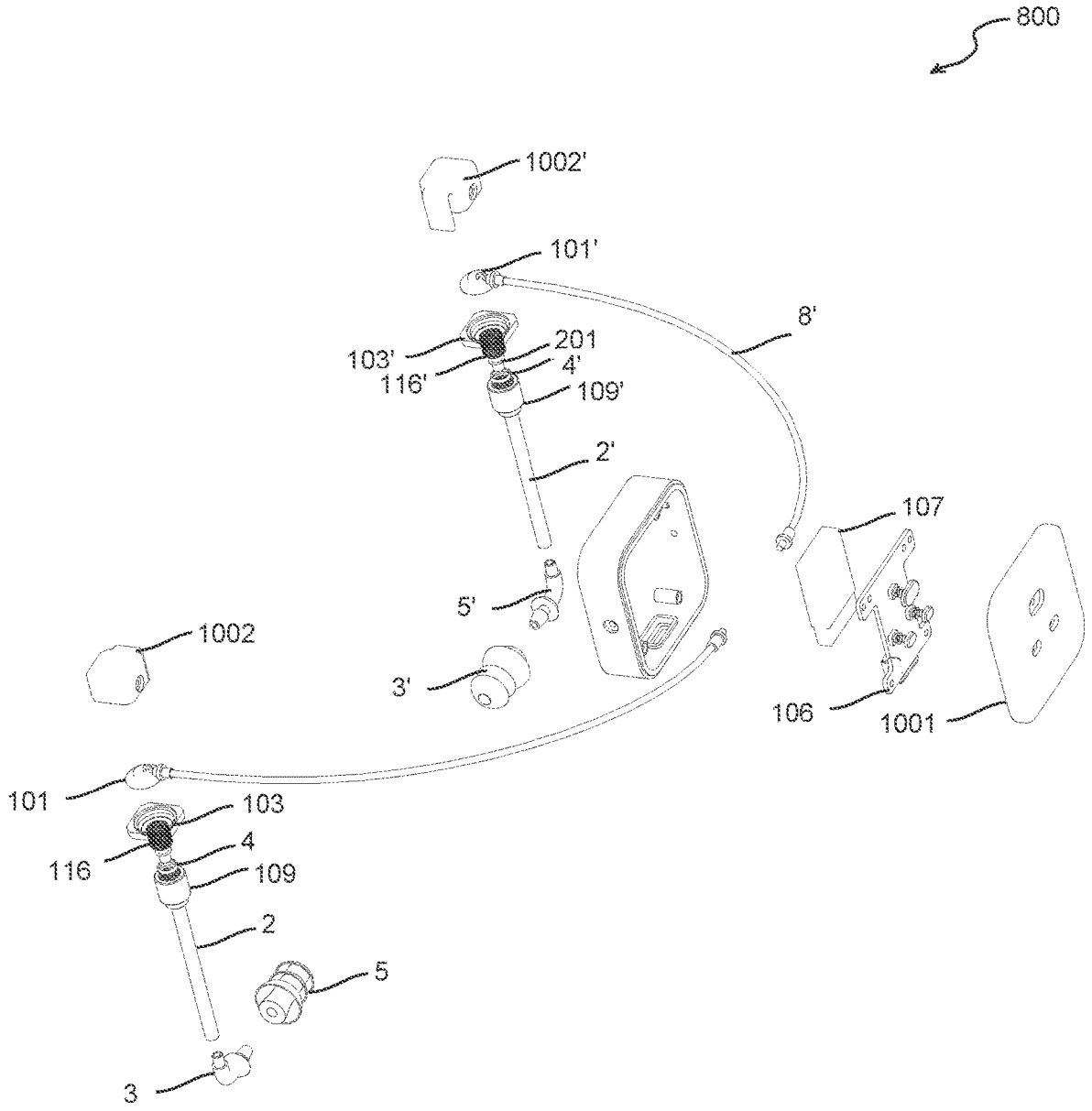
FIG. 8 is a schematic diagram of a structure of an earphone according to a further embodiment of the invention.

While much of the explanation of FIGS. 7-8 are with respect to one side of the earphones in the figures, given the generally symmetric nature of the earphones (i.e. similar mechanical and electrical features are used to provide sound to the user's left and right ears), the foregoing explanation similarly applies to the complementary parts of the headphones, such as the second speaker chamber 1002', electric wire 8', the second earphone tube 2', second speaker connector 116', second speaker support 103', second tube connector 109', second hollow rivet 201', second waterproof sealing piece 4', second speaker connector 116', second earphone tube 2', second earplug 3' and second junction 5'.

Figure 11:
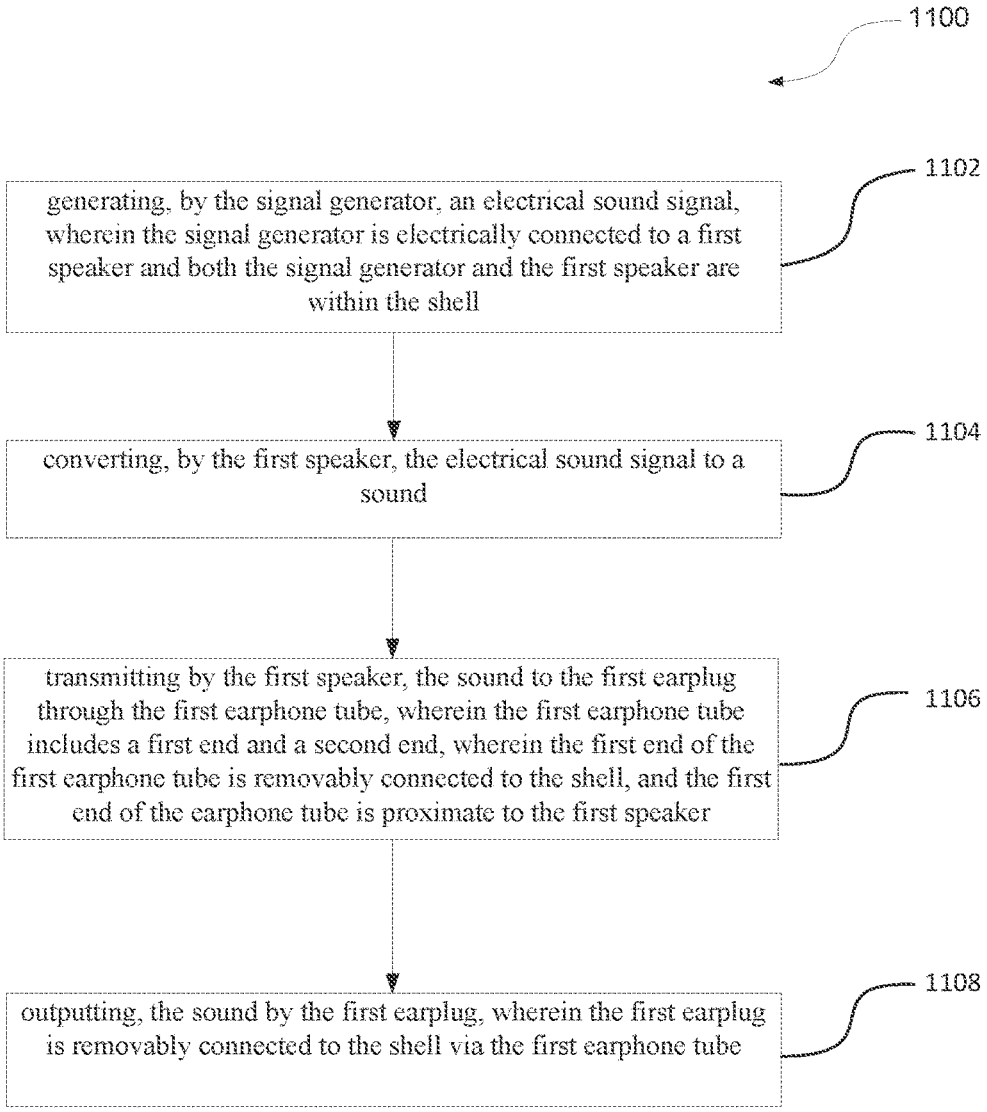
FIG. 11 is a flow chart of a method of operating the earphone according to an embodiment of the invention.

FIG. 11 is a flow chart of a method 1100 of operating the earphone according to an embodiment of the invention. The earphone comprises a shell, a signal generator, a first speaker, a first earphone tube and a first earplug. The method 1100 comprises generating in block 1102, by the signal generator, an electrical sound signal, wherein the signal generator is electrically connected to a first speaker and both the signal generator and the first speaker are within the shell; converting in block 1104, by the first speaker, the electrical sound signal to a sound; transmitting in block 1106, by the first speaker, the sound to the first earplug through the first earphone tube, wherein the first earphone tube includes a first end and a second end, wherein the first end of the first earphone tube is removably connected to the shell, and the first end of the earphone tube is proximate to the first speaker; and outputting in block 1108, the sound by the first earplug, wherein the first earplug is removably connected to the shell via the first earphone tube.

Some embodiments use the earphone tube 2, which is air conduction, to perform sound transmission, which is convenient to use. The earphone of the embodiments may be used in combination with other swimming equipment, in particular swimming goggles, and the earphone is fastened to the swimming goggles belt or headband. In addition, a pair of tube clips 7 and 7' are added on the earphone tubes 2 and 2' on both sides to prevent the earphone tube from being washed away by water during swimming. A junction 5 allows the alignment of the earplug 3 to be adjusted to align with user's ear canal to provide a better user experience, and allow users to listen to music while swimming.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense.

Features and aspects of various embodiments may be integrated into other embodiments, and embodiments illustrated in this document may be implemented without all of the features or aspects illustrated or described. One skilled in the art will appreciate that although specific examples and embodiments of the system and methods have been described for purposes of illustration, various modifications can be made without departing from the spirit and scope of the present invention. Moreover, features of one embodiment may be incorporated into other embodiments, even where those features are not described together in a single embodiment within the present document. Accordingly, the invention is limited only by the scope of the appended claims.

What is claimed is:

1. An earphone, comprising:

a shell, a signal generator and a first speaker, wherein the signal generator is electrically connected to the first speaker and both the signal generator and the first speaker are within the shell;

a first earphone tube comprising a first end and a second end, wherein the first end of the first earphone tube sealed by a waterproof sealing piece is removably connected to the shell, and the first end of the first earphone tube is proximate to the first speaker; and a first earplug removably connected to the first earphone tube by a first junction, wherein a sound generated by the first speaker is transmitted to the first earplug through the first earphone tube;

wherein a first hole is defined in the shell and proximate to the first speaker, and the first hole is provided with a waterproof and air-permeable membrane.

2. The earphone of claim 1, wherein the shell further comprises a power switch button, a volume up button and a volume down button disposed on an outer upper surface of the shell.

3. The earphone of claim 1, wherein the shell further comprises a shell connector protruding from a side of the shell and configured to connect a tube connector disposed on the first end of the first earphone tube via a threaded engagement, and the first earphone tube is removably connected to the shell.

4. The earphone of claim 3, wherein the first end of the first earphone tube further comprises a hollow rivet configured to connect to the tube connector.

5. The earphone of claim 3, wherein the shell connector is hollow.

6. The earphone of claim 3, wherein the waterproof sealing piece is disposed between the first earphone tube and the shell connector.

7. The earphone of claim 6, wherein the waterproof sealing piece comprises a silicone waterproof ring.

8. The earphone of claim 1, further comprising a PCB board and a battery, wherein the signal generator is disposed on the PCB board and the PCB board is electrically connected to the battery and disposed in the shell, wherein the signal generator comprises any one or more of a heart beat detector, a pulse detector, a breath detector, a speed sensor, a gyroscope, a magnetometer or an accelerometer.

9. The earphone of claim 8, wherein the signal generator comprises a sound playback module integrated with the PCB board.

10. The earphone of claim 8, wherein the signal generator comprises a transceiver integrated with the PCB board.

11. The earphone of claim 8, wherein the signal generator comprises a data detector integrated with the PCB board.

12. The earphone of claim 1, wherein the first junction is disposed between the first earphone tube and the first earplug and configured to be interference fit with the first earplug, wherein the first junction is further configured to be rotatable relative to a longitudinal axis of the first earphone tube so as to convert an alignment of the first earplug relative to a user's ear, and the first earplug is removably connected to the first earphone tube.

13. The earphone of claim 1, wherein the shell further comprises an upper shell and a lower shell configured to engage with each other to form a closed hollow structure.

14. The earphone of claim 1, wherein the shell further comprises a first speaker chamber configured to form a sealed cavity for the first speaker.

15. The earphone of claim 14, wherein the shell further comprises a second speaker chamber configured to form a sealed cavity for the second speaker, wherein the first speaker chamber and the second speaker chamber are sealed separately.

16. The earphone of claim 1, wherein a snap-fit connector extends from an outer surface of the shell and configured to mount the shell onto a band.

17. The earphone of claim 1, further comprising a second speaker, a second earphone tube and a second earplug, wherein the second earphone tube comprises a first end and a second end, wherein the first end of the second earphone tubes is removably connected to the shell, and the first end of the second earphone tube is proximate to the second speaker, a second hole is defined in the shell and proximate to the second speaker, and the second hole is provided with another waterproof and air-permeable membrane; and the second earplug is removably connected to the second earphone tube by a second junction, wherein a sound generated by the signal generator is transmitted to the second earplug through the second earphone tube.

18. The earphone of claim 1, wherein the shell further comprises a main chamber and a first speaker chamber, wherein the main chamber is configured to hold the signal generator, and the first speaker chamber is configured to hold the first speaker, wherein the main chamber is separate from the first speaker chamber, the main chamber is electrically connected to the first speaker chamber through an electric wire, and the first speaker chamber is connected to the first earplug via the first earphone tube.

19. The earphone of claim 18, wherein a first snap-fit connector extends from an outer surface of the main chamber and configured to mount the main chamber onto a band, a second snap-fit connector or a clip extends from a surface of the first speaker chamber and configured to mount the first speaker chamber to the band.

20. The earphone of claim 1, wherein the first earphone tube is provided with a position adjustable tube clip configured to clamp the first earphone tube to a band.

21. The earphone of claim 20, wherein the tube clip is a U-shaped clip, and clamping portions of the tube clip is made of elastic material.

22. The earphone of claim 1, wherein the first junction is made of any of thermoplastic polyurethanes (TPU), thermoplastic elastomer (TPE), as Polycarbonate (PC), Acrylonitrile Butadiene Styrene (ABS), or polyamide (PA).

23. The earphone of claim 1, wherein the first earplug is a three-layered pagoda shape.

24. A method of operating an earphone, wherein the earphone comprises a shell, a signal generator, a first speaker, a first earphone tube and a first earplug, the method comprises:

generating, by the signal generator, an electrical sound signal, wherein the signal generator is electrically connected to the first speaker and both the signal generator and the first speaker are within the shell;

converting, by the first speaker, the electrical sound signal to a sound;

transmitting by the first speaker, the sound to the first earplug through the first earphone tube, wherein a first hole is defined in the shell and proximate to the first speaker, and the first hole is provided with a waterproof and air-permeable membrane, the first earphone tube comprises a first end and a second end, wherein the first end of the first earphone tube sealed by a waterproof sealing piece is removably connected to the shell, and the first end of the earphone tube is proximate to the first speaker; and outputting, the sound by the first earplug, wherein the first earplug is removably connected to the first earphone tube by a first junction.

* * * * *